US011361745B2

(12) United States Patent
Saux et al.

(10) Patent No.: US 11,361,745 B2
(45) Date of Patent: Jun. 14, 2022

(54) HEADPHONE ACOUSTIC NOISE CANCELLATION AND SPEAKER PROTECTION

(71) Applicant: Apple Inc., Cupertino, CA (US)

(72) Inventors: Tom-Davy W. Saux, Los Altos, CA (US); Brian D. Clark, San Jose, CA (US); Thomas M. Jensen, San Francisco, CA (US); Vladan Bajic, San Francisco, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/019,774

(22) Filed: Sep. 14, 2020

(65) Prior Publication Data

US 2021/0097970 A1 Apr. 1, 2021

Related U.S. Application Data

(60) Provisional application No. 62/907,315, filed on Sep. 27, 2019.

(51) Int. Cl.
*G10K 11/178* (2006.01)
*H04R 1/10* (2006.01)
(Continued)

(52) U.S. Cl.
CPC .. *G10K 11/17854* (2018.01); *G10K 11/17881* (2018.01); *H04R 1/1016* (2013.01);
(Continued)

(58) Field of Classification Search
CPC ..... G10K 11/17854; G10K 11/17881; G10K 2210/1081; G10K 2210/3026; G10K 2210/3027; G10K 2210/3028; G10K 2210/3035; G10K 2210/30351; G10K 2210/3044; H04R 1/1016; H04R 1/406; H04R 3/005
(Continued)

(56) References Cited

U.S. PATENT DOCUMENTS 5,359,665 A 10/1994 Werrbach
7,016,509 B1 3/2006 Bharitkar et al.
(Continued)

FOREIGN PATENT DOCUMENTS

EP 2239728 10/2010

OTHER PUBLICATIONS

Non-Final Office Action for U.S. Appl. No. 17/023,314 dated Sep. 16, 2021, 26 pages.
(Continued)

*Primary Examiner* — William A Jerez Lora
(74) *Attorney, Agent, or Firm* — Womble Bond Dickinson (US) LLP

(57) ABSTRACT

An audio system has an ambient sound enhancement (ASE) function, in which an against-the-ear audio device having a speaker converts a digitally processed version of an input audio signal into amplified sound. The amplification may be in accordance with a stored hearing profile of the user. The audio system also has an acoustic noise cancellation (ANC) function that may be combined in various ways with the ASE function, and that may be responsive to voice activity detection. Other aspects are also described and claimed.

19 Claims, 3 Drawing Sheets

(51) Int. Cl.
*H04R 1/40* (2006.01)
*H04R 3/00* (2006.01)

(52) U.S. Cl.
CPC ..... *H04R 1/406* (2013.01); *H04R 3/005* (2013.01); *G10K 2210/1081* (2013.01); *G10K 2210/3026* (2013.01); *G10K 2210/3027* (2013.01); *G10K 2210/3028* (2013.01); *G10K 2210/3044* (2013.01)

(58) Field of Classification Search
USPC ..... 381/13, 56, 71.6, 71.8, 74, 71.14
See application file for complete search history.

(56) References Cited

U.S. PATENT DOCUMENTS

| | | | |
|---|---|---|---|
| 7,171,010 | B2 | 1/2007 | Martin et al. |
| 8,275,152 | B2 | 9/2012 | Smirnov et al. |
| 8,693,700 | B2 | 4/2014 | Bakalos et al. |
| 9,264,823 | B2 | 2/2016 | Bajic et al. |
| 9,515,629 | B2 | 12/2016 | Goldstein et al. |
| 9,633,646 | B2 * | 4/2017 | Hendrix ..... G10K 11/17855 |
| 10,034,092 | B1 * | 7/2018 | Nawfal ..... H04R 5/04 |
| 10,074,903 | B2 | 9/2018 | Kim et al. |
| 2003/0145025 | A1 | 7/2003 | Allred et al. |
| 2004/0032959 | A1 | 2/2004 | Montag et al. |
| 2008/0175409 | A1 | 7/2008 | Lee et al. |
| 2010/0195815 | A1 | 8/2010 | Tada |
| 2010/0266134 | A1 | 10/2010 | Wertz et al. |
| 2011/0007907 | A1 | 1/2011 | Park et al. |
| 2011/0142247 | A1 | 6/2011 | Fellers et al. |
| 2013/0259250 | A1 | 10/2013 | Nicholson et al. |
| 2014/0093090 | A1 | 4/2014 | Bajic et al. |
| 2014/0341388 | A1 | 11/2014 | Goldstein et al. |
| 2016/0300562 | A1 | 10/2016 | Goldstein |
| 2017/0125006 | A1 | 5/2017 | Dzhigan et al. |
| 2018/0047383 | A1 | 2/2018 | Hera et al. |
| 2019/0130930 | A1 * | 5/2019 | Tong ..... H04R 1/1083 |
| 2020/0098347 | A1 | 3/2020 | Kubota et al. |
| 2020/0374617 | A1 | 11/2020 | Liu et al. |

OTHER PUBLICATIONS

"Bose QuietComfort Earbuds", Retrieved from the Internet <https://www.bose.com/en_us/products/headphones/earbuds/quietcomfort-earbuds.html#v=qc_earbuds_black, Sep. 10, 2020, 15 pages.

Bristow-Johnson, Robert, "Cookbook formulae for audio equalizer biquad filter coefficients", Retrieved from the Internet <https://www.w3.org/2011/audio/audio-eq-cookbook.html>, May 29, 2020, 7 pages.

Notice of Allowance for U.S. Appl. No. 17/023,340 dated Aug. 19, 2021, 8 pages.

Notice of Allowance for U.S. Appl. No. 17/019,778 dated Jun. 24, 2021, 18 pages.

Notice of Allowance for U.S. Appl. No. 17/023,314 dated Feb. 11, 2022, 8 pages.

* cited by examiner

HEADPHONE ACOUSTIC NOISE CANCELLATION AND SPEAKER PROTECTION

This non-provisional patent application claims the benefit of the earlier filing date of U.S. provisional application No. 62/907,315 filed Sep. 27, 2019.

FIELD

An aspect of the disclosure here relates to digital audio signal processing techniques for protecting a speaker of a headphone while it is being used by an acoustic noise cancellation system. Other aspects are also described.

BACKGROUND

Headphones come in various fit types, such as an over-ear that partially rests directly against the head and surrounds the ear, an on-ear that rests against the ear, and in-ear that at least partially fits into the ear canal. In the case where the headphone is physically designed to acoustically and passively isolate ambient noise, especially in the case of a sealed in-ear headphone, there is a pocket of air that becomes essentially trapped either entirely in a blocked ear canal or between the ear and the main sound output port of the headphone. This trapped pocket of air induces the so-called occlusion effect, where the wearer perceives a louder and unnatural version of their own voice when talking. It is possible to mitigate this aspect of the occlusion effect when the user is talking, by configuring an acoustic noise cancellation, ANC, system (also referred to as an active noise reduction system) to actively reproduce the user's own voice through the speaker of the headphone.

SUMMARY

An aspect of the disclosure here relates to an audio system in a headphone, in which a speaker of the headphone is fed at least the following signals: a first audio signal, from an internal microphone, that has been processed in a feedback path; and a second audio signal, from an external microphone, that has been processed in a feedforward path. The feedforward and feedback paths may be part of an ANC system and can be configured to process the respective audio signals to result in anti-noise produced by the speaker, intended to acoustically cancel any external or ambient noise (undesired sound) that has made its way past the headphone and into the wearer's ear. But the ANC system may over drive the speaker, under certain circumstances such as loud ambient sound levels typically present for example in a pop or rock concert, or high sound pressure levels created within the wearer's ear due to their walking while their ear canal is blocked by the headphone. A speaker is being overdriven when its input audio signal is so strong as to cause its diaphragm or other vibrating, sound radiating element to reach an excursion or displacement limit. This risks damaging the speaker. To mitigate this, the audio system has a digital processor programmed to perform a method for signal processing of the microphone signals of the headphone, as described next.

The method includes the processor filtering the audio signals that are from a first microphone and from a second microphone, thereby producing first and second filtered signals, respectively. These filtered signals may be produced by the adaptive filters of a feedforward and feedback acoustic noise cancellation system (implemented as the programmed processor.) Such filters are configured during a noise cancellation mode of operation, to produce anti-noise signals. The processor then performs a dynamic range control process upon those filtered signals, to produce first and second dynamic range adjusted signals, which it then combines into a single audio signal that drives a speaker (having one or more drivers or sound output transducers) of the headphone. To maintain the headphone listening experience of the user (wearer), the dynamic range control process may be designed to operate with reduced latency and to modify one or both of the filtered signals only when needed to prevent the speaker from reaching its excursion limit. This method is particularly effective in protecting the speaker of a sealing, in-ear type headphone against overdriving that may be caused when the user is walking and when the user is in a loud ambient environment such as a pop concert or a loud restaurant or social club.

In another aspect, referred to as a cascade approach, the dynamic range control includes producing the first DRC adjusted signal by a first low shelf cut filter, and then applying a second low shelf cut filter to the first DRC adjusted signal. A transition frequency of the second low shelf filter is varied based on side chain processing of the first DRC adjusted signal, wherein the transition frequency of the second low shelf filter is higher than the transition frequency of the first low shelf filter. Applying the second low shelf filter (that has a higher transition frequency than the first low shelf filter) further reduces energy of the first filtered audio signal, and is applied only if the first low shelf filter was unable to sufficiently reduce energy of the filtered audio signal.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description.

Figure 1:
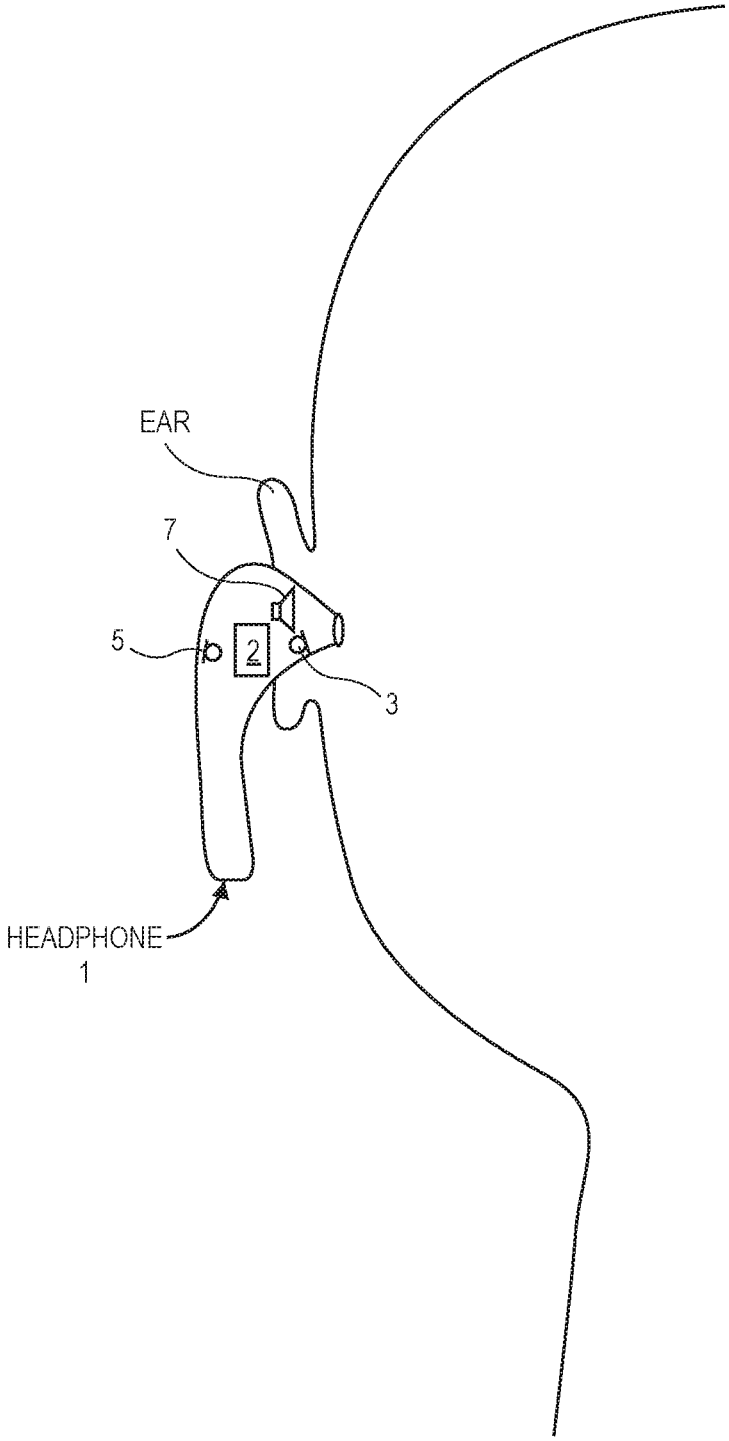
FIG. 1 shows an example headphone.

FIG. 1 shows an example of a headphone 1 being worn by its user (wearer), in which the systems and methods for digital audio signal processing described below can be implemented. The headphone shown is an in-ear earbud, an in-ear headphone which may be a sealing-type that has a flexible ear tip that serves to acoustically seal off the entrance to the user's ear canal from the ambient environment by blocking or occluding in the ear canal (thereby achieving strong passive ambient sound isolation.) The headphone 1 may be one of two headphones (left and right) that make up a headset. The methods described below can be implemented in one or both of the headphones that make up a headset. Alternatives (not shown) to the sealing type in-ear earbud include a closed back, on-the-ear headphone or an over-the-ear headphone that also creates a strong, passive ambient sound barrier. In both instances, a pocket of air is trapped at least partly within the ear, e.g., due to occlusion or blockage of the ear canal in the case of a sealing-type in-ear headphone.

The headphone 1 has an against-the-ear acoustic transducer or speaker 7 arranged and configured to reproduce sound (that is represented in an audio signal) directly into the ear of a user, an external microphone 5 (arranged and configured to receive ambient sound directly), and an internal microphone 3 (arranged and configured to directly receive the sound reproduced by the speaker 7.) The headset is configured to acoustically couple the external microphone to an ambient environment of the headphone, in contrast to the internal microphone being acoustically coupled to a trapped volume of air within the ear that is being blocked by the headphone. In one variation, as integrated in the headphone and worn by its user, the external microphone 5 may be more sensitive than the internal microphone 3 to a far field sound source outside of the headphone. Viewed another way, as integrated in the headphone and worn by its user, the external microphone 5 may be less sensitive than the internal microphone 3 to sound within the user's ear. Here it should be noted that while the figures show a single microphone symbol in each instance (external microphone 5 and internal microphone 3), as producing a sound pickup channel, this does not mean that the sound pickup channel must be produced by only one microphone. In some instances, the sound pickup channel may be the result of combining multiple microphone signals, e.g., by a beamforming process performed on a multi-channel output from a microphone array—this variation or option is depicted in dotted lines in the figures, as additional external microphones and a beamforming process.

In one aspect, along with the transducers and the electronics that process and produce the transducer signals (output microphone signals and an input audio signal to drive the speaker), there is also electronics that is integrated in the headphone housing. Such electronics may include an audio amplifier to drive the speaker with an audio signal (that may include program audio), a microphone sensing circuit or amplifier that receives the microphone signals converts them into a desired format for digital signal processing, and a digital processor 2 and associated memory (not shown), where the memory stores instructions for configuring or programing the processor (e.g., instructions to be executed by the processor) to perform digital signal processing methods as described below in detail. A playback signal (program audio) that may contain user content such as music, podcast, or the voice of a far end user during a voice communication session can also be provided to drive the speaker in some modes of operation, e.g., during noise cancellation mode. The playback signal may be provided to the processor from an external, companion audio source device (not shown in the example of FIG. 1) such as a smartphone or tablet computer. Alternatively, the playback signal could be provided to the processor by a cellular network communications interface that is within the housing of the headphone.

Figure 2:
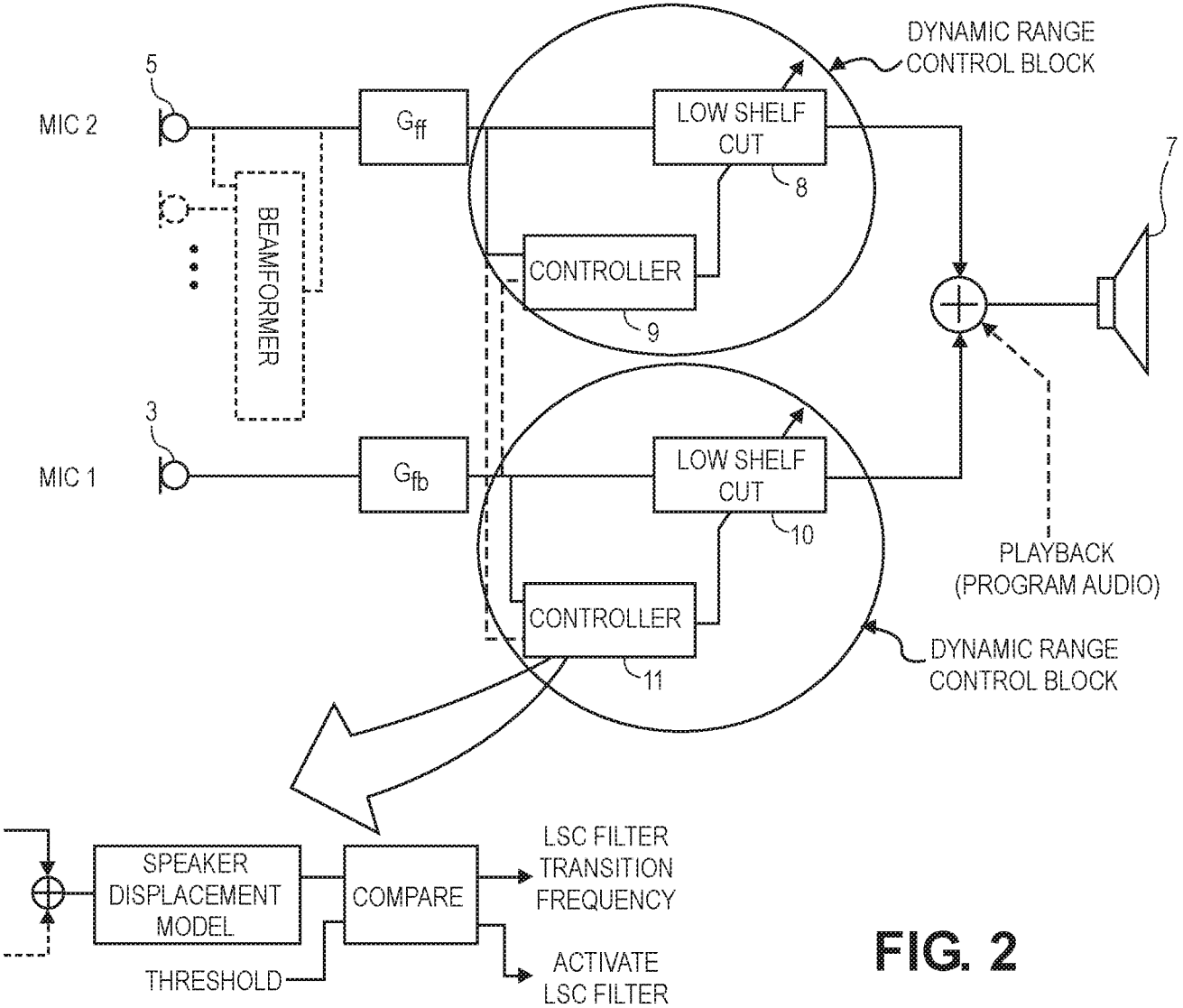
FIG. 2 is a block diagram of an audio signal processing system and method that that achieves speaker protection in the context of an acoustic noise cancellation, ANC, system that has feedforward and feedback paths.

Turning now FIG. 2, a block diagram of a system and method for audio signal processing of microphone signals of a headphone is shown. An audio signal from a first microphone of a headphone, e.g., internal microphone 3, is filtered by a Gfb block to produce a first filtered signal, while an audio signal from a second microphone of the headphone, e.g., external microphone 5, is filtered by a Gff block to produce a second filtered signal. In one or both of these cases, this digital filtering of the audio signal from the microphone is performed by an acoustic noise cancellation system. The audio signal from the first microphone is filtered as part of a feedback signal processing path of the acoustic noise cancellation system, while the audio signal from the second microphone is filtered by a feedforward signal processing path of the acoustic noise cancellation system. One or both of the feedforward and feedback paths, and in particular the Gff and Gfb blocks, can be configured into a noise cancellation mode of operation: the Gff block produces an output signal may be designed to cancel undesired ambient sound sensed by the external microphone and that may have leaked past the seal into the trapped air pocket in the user's ear; the Gfb block produces an output signal that may be designed to cancel undesired sound in the trapped air pocket in the user's ear that is detected by the internal microphone; either or both may drive the speaker 7 to produce "anti-noise", often simultaneously. In the latter case, in the version shown in FIG. 2, both of the output signals from Gff and Gfb are combined (represented by the summing junction) into a single audio signal that is driving the speaker 7.

Note that in some cases, the noise cancellation mode of operation is performed during user content media playback, where a program audio signal containing for example music or a podcast or the voice of a far end user in a phone call is also combined into the single audio signal that is driving the speaker 7. In other cases, the program audio signal is silent during noise cancellation mode.

As explained above, there are instances where the output signals from one or both of the feedforward and feedback paths of the ANC system can overdrive the speaker 7, such as when the user is walking (footfall events) and/or when the ambient environment is loud (e.g., rock or pop concert.) This problem is more likely when the headphone 1 is a sealing, in-ear type. To mitigate this, dynamic range control is performed upon the first filtered signal from Gfb, to produce a first dynamic range adjusted signal, and upon the second filtered signal from Gff, to produce a second dynamic range adjusted signal, before driving the speaker 7. In the example of FIG. 2, the first dynamic range adjusted signal and the second dynamic range adjusted signal are combined (as indicated by the summing junction) into the single audio signal that drives the speaker 7 of the headphone.

In one instance, the dynamic range control includes downward compressing the first filtered signal, and/or downward compressing the second filtered signal. This reduces the magnitude of a component of the speaker input signal (e.g. the first filtered signal produced by the feedback path) which helps reduce sound pressure in the trapped volume of air. That sound pressure would otherwise increase beyond normal loud sounds, due to footfall events (e.g. the user is walking, hopping, rolling over a bump).

Still referring to FIG. 2, in one aspect of the disclosure here, dynamic range control includes the particular approach depicted in FIG. 2, where side chain processing of at least the first filtered signal is performed, by a controller 11 applying the first filtered signal to a speaker displacement model that yields a speaker displacement function in time domain. There is the option of also considering the second filtered signal when performing the side chain processing, as indicated by the dotted line connecting the output of the Gff block to the controller 11. A gain reduction is performed upon the first filtered signal in response to the controller 11 detecting that a signal level of the displacement function exceeds a threshold. In the example of FIG. 2, gain reduction is performed by a low shelf cut filter 10 filtering the first filtered signal. The low shelf cut filter attenuates frequencies below a transition frequency, and does not change the gain above the transition frequency (e.g., the gain change is negative dB below the transition frequency, and 0 dB above it.) The ANC system is effective above the transition to frequency, and is not disturbed by the low shelf cut filter. Dynamic range control may be achieved using such an arrangement, because the controller varies the transition frequency of the low shelf cut filter based on the speaker displacement function. In other words, the transition frequency is varied in accordance with the estimated speaker displacement, which is being computed in real-time, e.g., on a sample-by-sample basis.

Note that while a low shelf cut filter attenuates frequencies below its transition frequency, its response flattens out to a certain level that still passes through the input signal at a meaningful level. This is contrast to a low pass filter. While it too attenuates frequencies below a cutoff frequency, the frequency response of a low pass filter generally maintains a continuous roll off as the frequency drops until the input signal is essentially no longer passed through.

Also, it should be noted that in this disclosure, detecting signal level (for example when evaluating the speaker displacement function) refers to a generic way of covering different techniques of determining the wide-band strength of a signal. This is in contrast to computing narrow band strengths, in given frequency bins for instance. Detecting the signal level may include for example envelope detection. Time domain techniques for envelope detection may be more suitable here, to ensure low latency in the response by the controller 11.

Similar to the dynamic range control of the feedback path (at the output of the Gfb block), dynamic range control may also be performed in the feedforward path, and particularly upon the second filtered signal that is produced at the output of Gff block. This produces a second dynamic range adjusted signal which is then combined with the first dynamic range adjusted signal (at the summing junction shown) into an audio signal that drives the speaker 7 of the headphone. In this particular case, an approach for dynamic range control that is similar to the one applied to the feedback path is taken, namely using a controller 9 that, similar to the controller 11, performs side chain processing of at least the output of the Gff block in the same manner as described above (applying the filtered signal to the input of a speaker displacement model and comparing the resulting speaking displacement function to a threshold based on which a transition frequency of a low shelf cut filter 8 is computed.) An option here is to also consider the first filtered signal when performing the side chain processing, as indicated by the dotted line connecting the output of the Gfb block to the controller 9. For example, the two filtered signals may be combined, as represented by the summing junction, into a single audio signal that is then input to the speaker displacement model.

The dynamic range control applied to the output of the Gff block may serve to reduce the magnitude of the output of the feedforward path, so that the speaker 7 is less likely to be overdriven when the user is in a loud ambient environment. As to the dynamic range control applied to the output of the Gfb block, that may serve to reduce the magnitude of the output of the feedback path, so that the speaker 7 is less likely to be overdriven during footfall events (e.g., the user is walking or riding over bumps.) As most of the energy in footfall events is below 50 Hz, the transition frequency of the low shelf cut filter 10, and perhaps also that of the low shelf cut filter 8, may vary between 20 Hz to 50 Hz. Thus, the speaker 7 is protected against the disturbances caused by footfall in both quiet and loud ambient environments, while both the feeedforward and feedback paths of the ANC system are active.

One of the problems encountered when seeking to protect the speaker 7 against being overdriven is how to keep the delay in responding to a detected overdriving condition (in the feedback and/or feedforward paths) as short as possible. A solution here is to perform the filtering by the Gfb block, the filtering by the low shelf filter, and the side chain processing (to determine the transition frequency of the low shelf filter), in time domain. For example, the filtering and side chain processing may all be performed without converting any of their input signals into frequency domain or sub-band signals, so as to avoid introducing too much latency into the feedback paths. Also, using a low shelf filter in the dynamic range control also helps keep the delay as short as possible, because of such a filter's desirable phase response characteristics. These observations also apply in a similar manner to reduce latency when responding to a detected overdriving condition in the feedforward path.

Figure 3:
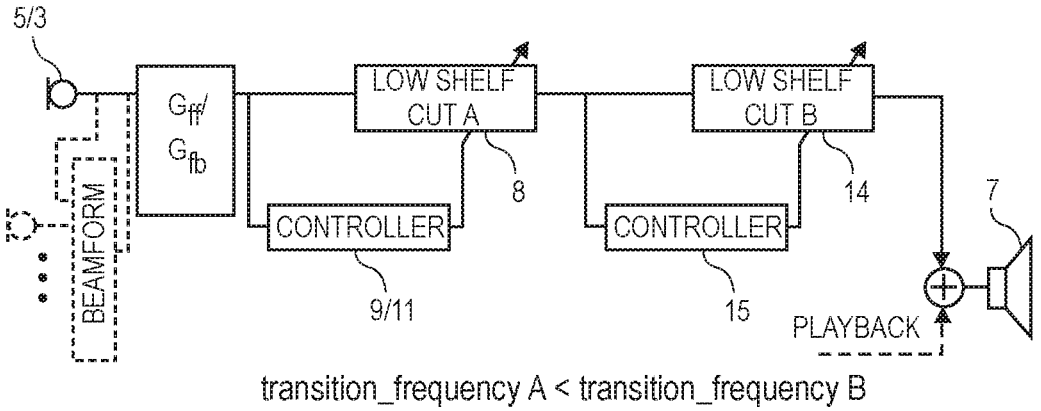
FIG. 3 is a block diagram of a two stage audio signal processing system and method that achieves speaker protection in the context of an ANC system having at least a feedforward path or a feedback path.

Referring now to FIG. 3, this is a block diagram of a two stage audio signal processing system and method that achieves speaker protection, in the context of an ANC system having at least a feedforward path or a feedback path. Here, the dynamic range control performed upon the output of the Gff block (or the Gfb block) includes filtering the filtered signal using a cascade of low shelf filters, namely low shelf cut filter 8 (filter A) and low shelf cut filter 14 (filter B.) The output of the low shelf cut filter 14 is then provided to drive the speaker 7 (optionally while combined with a playback signal.) The two low shelf filters of the cascade are time-varying digital filters whose transition frequencies are variable. Side chain processing (e.g., as described above in connection with FIG. 2, using the controller 9 or the controller 11) is performed on the input to each of filter A and filter B, where the controller 9, 11 activates and configures filter A and a controller 15 activates and configures filter B. Each of these controllers has a speaker displacement model and comparison block that operate as described above in connection with FIG. 2, upon the input signal of its associated low shelf filter of the cascade, to activate and then vary the transition frequencies of the low shelf filters. In one aspect, the transition frequency of the second low shelf filter 14 (filter B) remains greater than the transition frequency of the first low shelf filter 8 (filter A), while both are being varied in real-time in accordance with the side chain processing.

It should be noted that if there is no footfall event and the ambient environment is not loud, then the side chain processing performed by each of the controller 9, the controller 11 (FIG. 2), and the controller 15, should be designed to effectively recognize such a situation, and respond by omitting the low shelf cut filters 8, 10, or not activating them, in the feedforward and feedback paths. In some cases, however, referring now to the cascade solution in FIG. 3, the controller 9 could determine that its input signal is too strong (based on the side chain processing of FIG. 2 determining that the speaker displacement function is exceeding the threshold) such that filter A is needed to attenuate the input signal, but then the controller 15 could determine that the output of filter A translates to a speaker displacement that is less than its threshold. As a result, the filter B is not needed and is therefore omitted (by the controller 15.) This careful use of the attenuation capabilities of the low shelf cut filter cascade avoids impacting the user's listening experience unnecessarily, by not adding the filter A (to the feedforward or feedback path) unless speaker displacement is above a threshold, and then adding filter B only if filter A did not result in sufficient attenuation.

Figure 4:
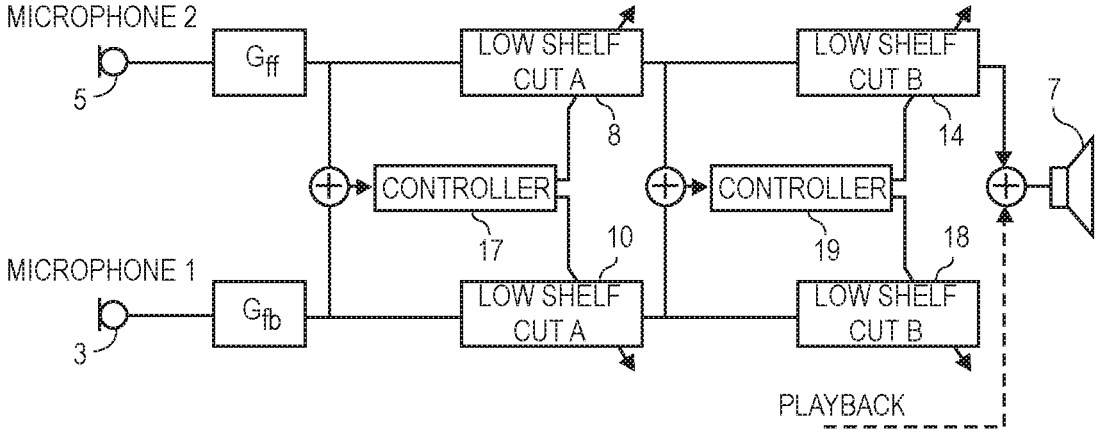
FIG. 4 is a block diagram of a two stage audio signal processing system and method that achieves speaker protection in the context of an ANC system having both a feedforward path and a feedback path.

Turning now to FIG. 4, this is a block diagram of a two stage audio signal processing system and method that achieves speaker protection in the context of an ANC system having both a feedforward path and a feedback path. This approach has some similarity to FIG. 2, and some similarity to FIG. 3. It is somewhat similar to FIG. 2 in that a controller 17 uses both of the Gff and Gfb output signals, e.g., their sum, to determine whether or not to attenuate them using low shelf cut filters 8, 10. It is different than FIG. 2, and somewhat similar to the cascade approach in FIG. 3, in that the dynamic range control, DRC, of this approach adds to the concept of DRC in FIG. 2, by combining a first dynamic range adjusted signal that is at the output of the low shelf cut filter 10 with a second dynamic range adjusted signal that is at the output of the low shelf cut filter 8, into a combination audio signal that is then provided to a controller 19. The controller 19 applies the combination audio signal to a speaker displacement function, and while detecting signal level of the speaker displacement function (e.g., detecting envelope and comparing to a threshold), configures another pair of low shelf cut filters 14, 18 based on the speaker displacement function. Those filters 18, 14 are filtering the first and second dynamic range adjusted signals, respectively, based upon the speaker displacement function.

Figure 5:
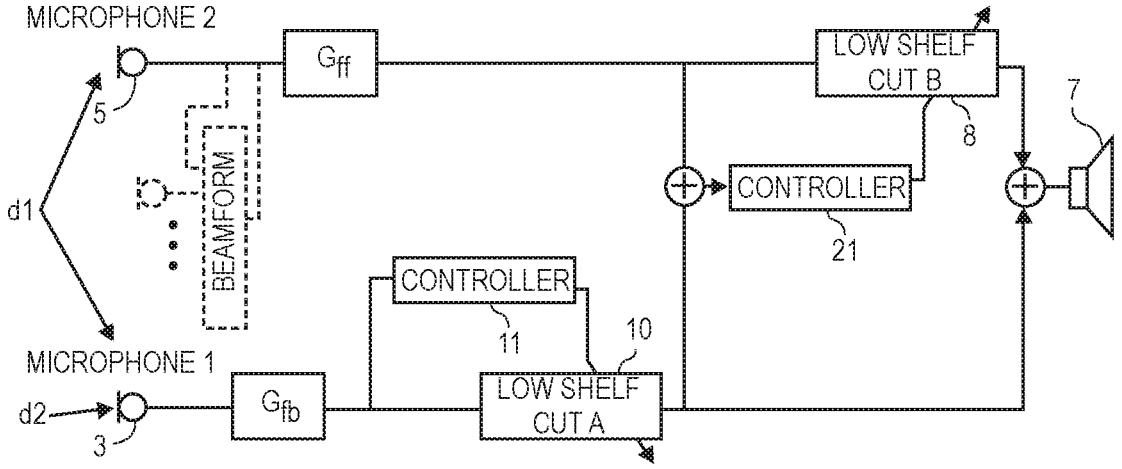
FIG. 5 is a block diagram of an audio signal processing system and method that achieves speaker protection in the context of an ANC system having both a feedforward path and a feedback path, using linked compressors.

In FIG. 5, a block diagram of another audio signal processing system and method that achieves speaker protection in the context of an ANC system having both a feedforward path and a feedback path is shown, this time using linked compressors. The compressors that are being linked here are the ones that produce a first dynamic adjusted signal at the output of the low shelf cut filter 10 (in the path of the Gfb block or the feedback path), and a second dynamic range adjusted signal at the output of the low shelf cut filter 8 (in the path of the Gff block of the feedforward path.) In contrast to FIG. 2 however, here the first dynamic range adjusted signal is combined with the second filtered signal (at the output of the Gff block) into a combination audio signal which is then processed by a controller 21. The controller 21 applies the combination audio signal to a speaker displacement function and is detecting signal level of the speaker displacement function. The controller 21 configures the low shelf cut filter 8 which in turn filters the second filtered signal (at the output of the Gff block) based upon the speaker displacement function. For example, and as described above, the transition frequency of the low shelf cut filter 8 can be varied in real-time by the controller 21. The output of the low shelf cut filter 8, which is referred to here as a second dynamic range adjusted signal is then combined with the first dynamic range adjusted signal before driving the speaker 7.

The effect of the version shown in FIG. 5 may be described as follows. The dynamic range control is performed upon the feedforward path (the second filtered signal which is at the output of the Gff bloc) as follows: apply the first dynamic range adjusted signal (of the feedback path) to a speaker displacement function; detect signal level of the speaker displacement function; and then filter the feedforward path (using a time-varying low shelf filter) but only if the "residual" audio signal, or the first dynamic range adjusted signal, when combined with the feedforward path has not been sufficiently attenuated. In other words, the feedforward path is not dynamic range adjusted (the low shelf filter 8 is effectively omitted) if the speaker displacement component that is due to the dynamic range adjusted feedback path is below the threshold. This helps maintain the listening experience by avoiding unnecessary filtering. For example, if there is a disturbance d1 which is so strong that it impacts both the external microphone 5 and the internal microphone 3 (e.g., airplane nearby or loud rock or pop concert), then even though the controller 11 responds to d1 by attenuating the feedback path, the feedforward path component is also strong and hence has to be attenuated by the controller 21. If the disturbance is d2 which only impacts internal microphone 3 (e.g., footfall), then the action of controller 11 in attenuating the feedback path is sufficient—in that case, the controller 21 will not attenuate the feedforward path (because the sum of the attenuated feedback path and the output of the Gff will be below a threshold).

In this disclosure, microphone signals are processed by an ANC system and are translated into speaker displacement functions, for purposes of speaker protection. Thus, the use of personally identifiable information is not likely to be needed in this disclosure. However, it should be understood that any such use should follow privacy policies and practices that are generally recognized as meeting or exceeding industry or governmental requirements for maintaining the privacy of users. In particular, personally identifiable information should be managed and handled so as to minimize risks of unintentional or unauthorized access or use, and the nature of authorized use should be clearly indicated to users.

To aid the Patent Office and any readers of any patent issued on this application in interpreting the claims appended hereto, applicant wishes to note that they do not intend any of the appended claims or claim elements to invoke 35 U.S.C. 112(f) unless the words "means for" or "step for" are explicitly used in the particular claim.

While certain aspects have been described and shown in the accompanying drawings, it is to be understood that such are merely illustrative of and not restrictive on the broad invention, and that the invention is not limited to the specific constructions and arrangements shown and described, since various other modifications may occur to those of ordinary skill in the art. For example, although not shown in FIG. 2, the microphone signal containing the ambient sound (from the external microphone 5) may have been processed by an equalization, EQ, filter which serves to spectrally shape the microphone signal, before arriving at the input of the Gff filter. Also, a limiter (not shown) may be added downstream of the output of the summing junction and upstream of the speaker 7. The description is thus to be regarded as illustrative instead of limiting.

What is claimed is:

1. A method for audio signal processing of microphone signals of a headphone, the method comprising:

filtering an audio signal from a first microphone of a headphone to produce a first filtered signal;

filtering an audio signal from a second microphone of the headphone to produce a second filtered signal;

performing dynamic range control upon the first filtered signal to produce a first dynamic range adjusted signal by i) side chain processing of the first filtered signal by applying the first filtered signal to a speaker displacement model that yields a speaker displacement function in time domain, and ii) performing gain reduction upon the first filtered signal in response to detecting that a signal level of the displacement function exceeds a threshold;

performing dynamic range control upon the second filtered signal to produce a second dynamic range adjusted signal; and combining the first dynamic range adjusted signal and the second dynamic range adjusted signal into an audio signal that drives a speaker of the headphone.

2. The method of claim 1 wherein as integrated in the headphone, the first microphone is more sensitive than the second microphone to sound within a user's ear that is being blocked by the headphone.

3. The method of claim 1 wherein as integrated in the headphone the second microphone is more sensitive than the first microphone to a far field sound source outside of the headphone.

4. The method of claim 1 wherein filtering the audio signal from the first microphone is performed by an acoustic noise cancellation system.

5. The method of claim 1 wherein filtering the audio signal from the second microphone is performed by an acoustic noise cancellation system.

6. The method of claim 1 wherein filtering the audio signal from the first microphone is performed by a feedback signal processing path of an acoustic noise cancellation system, and filtering the audio signal from the second microphone is performed by a feedforward signal processing path of the acoustic noise cancellation system, and the speaker produces anti-noise.

7. The method of claim 1 wherein the headphone is a sealing, in-ear type.

8. The method of claim 1 further comprising a. performing a beamforming process upon signals from a plurality of microphones that include the second microphone, to produce the audio signal from the second microphone.

9. The method of claim 1 wherein performing dynamic range control comprises compressing the first filtered signal.

10. The method of claim 1 wherein performing dynamic range control comprises performing said gain reduction by:

filtering the first filtered signal using a low shelf filter that attenuates frequencies below a transition frequency;

and varying a transition frequency of the low shelf filter based on the speaker displacement function.

11. The method of claim 10 wherein filtering the audio signal from the first microphone, filtering the first filtered signal using the low shelf filter, and side chain processing of the first filtered signal to determine the transition frequency of the low shelf filter, are performed in time domain.

12. The method of claim 1 wherein performing dynamic range control comprises:

performing said gain reduction by filtering the first filtered signal using a first cascade of first and second low shelf filters;

filtering the second filtered signal using a second cascade of first and second low shelf filters; and performing side chain processing of input signals to the first and second cascades to vary transition frequencies of the low shelf filters.

13. The method of claim 12 wherein in a given cascade, a transition frequency of the second low shelf filter is greater than a transition frequency of the first low shelf filter.

14. The method of claim 1 wherein performing dynamic range control comprises:

combining the first dynamic range adjusted signal and the second dynamic range adjusted signal into a first combination audio signal;

applying the first combination audio signal to a speaker displacement function;

detecting signal level of the speaker displacement function; and filtering the first and second dynamic range adjusted signals using respective low shelf filters and based upon the signal level of the speaker displacement function.

15. The method of claim 14 wherein performing dynamic range control comprises:

varying a transition frequency of the respective low shelf filters based on side chain processing of the first combination audio signal.

16. The method of claim 1 wherein performing dynamic range control upon the second filtered signal comprises:

applying the first dynamic range adjusted signal to a speaker displacement function;

detecting signal level of the speaker displacement function; and filtering the second filtered signal using a low shelf filter but only if the detected signal level of the speaker displacement function is greater than a threshold.

17. A headphone comprising:

a speaker, a first microphone and a second microphone integrated into a headphone housing;

a processor; and memory having stored therein instructions that the processor executes for audio signal processing of signals from the first and second microphones by filtering an audio signal from the first microphone to produce a first filtered signal;

filtering an audio signal from the second microphone to produce a second filtered signal;

performing dynamic range control upon the first filtered signal to produce a first dynamic range adjusted signal by i) filtering the first filtered signal using a low shelf filter that attenuates frequencies below a transition frequency, ii) applying the first filtered signal to a speaker displacement model that yields a speaker displacement function in time domain, and iii) varying a transition frequency of the low shelf filter based on the speaker displacement function;

performing dynamic range control upon the second filtered signal to produce a second dynamic range adjusted signal; and combining the first dynamic range adjusted signal and the second dynamic range adjusted signal into an audio signal that drives a speaker of the headphone.

18. The headphone of claim 17 wherein the memory has stored therein instructions that the processor executes to filter the audio signal from the first microphone in a feedback signal processing path of an acoustic noise cancellation system, and to filter the audio signal from the second microphone in a feedforward signal processing path of the acoustic noise cancellation system.

19. The headphone of claim 17 wherein the memory has stored therein instructions that the processor executes so that filtering the audio signal from the first microphone, filtering the first filtered signal using the low shelf filter, and side chain processing of the first filtered signal to determine the transition frequency of the low shelf filter, are performed in time domain.

* * * * *